United States Patent [19]

Katase et al.

[11] Patent Number: 4,704,731

[45] Date of Patent: Nov. 3, 1987

[54] PACKING INSIDE BAG FOR VISCOUS MATERIAL

[75] Inventors: Haruhisa Katase; Yasuo Rokushima; Tosio Yanagi, all of Yokohama, Japan

[73] Assignee: Nippon Petrochemicals Co., Ltd., Japan

[21] Appl. No.: 828,396

[22] Filed: Feb. 11, 1986

[30] Foreign Application Priority Data

Feb. 15, 1985 [JP] Japan ..... 60-20282[U]

[51] Int. Cl.[4] ..... B65D 30/20

[52] U.S. Cl. ..... 383/120; 383/122; 383/66; 220/408; 220/410

[58] Field of Search ..... 206/527; 383/120, 122, 383/66; 220/470, 408, 410

[56] References Cited

U.S. PATENT DOCUMENTS

| | | | |
|---|---|---|---|
| 2,092,858 | 9/1937 | Richard | 383/122 |
| 2,169,638 | 8/1939 | Gilfillan | 383/122 |
| 2,392,206 | 1/1946 | Waters | 383/122 |
| 2,406,791 | 9/1946 | Belcher | 383/122 |
| 3,041,941 | 7/1962 | Danielzig | 383/122 |
| 3,144,188 | 8/1964 | Gallistel | 220/470 |
| 3,317,117 | 5/1967 | Goodwin | 383/122 |
| 3,822,037 | 7/1974 | Long | 220/470 |
| 4,082,216 | 4/1978 | Clarke | 220/470 |
| 4,189,089 | 2/1980 | Langen et al. | 383/120 |
| 4,428,499 | 1/1984 | Nauheimer | 220/470 |

*Primary Examiner*—Stephen Marcus
*Assistant Examiner*—David T. Fidei
*Attorney, Agent, or Firm*—Ostrolenk, Faber, Gerb & Soffen

[57] ABSTRACT

The present invention provides a packing inside bag for a semisolid viscous material which is constructed by folding one rectangular blank sheet an inner surface of which has release properties, said inside bag being characterized by comprising a rectangular bottom surface 1 formed so as to fit to an outside box, and a front wall 3, a rear wall 3*a* and pairs of side walls (8, 8*a* and 9, 9*a*) which are uprightly raised along the four side edges of said bottom surface 1, said inside box being constructed by folding said blank sheet so that first lugs A, A′ extending uprightly along the centers of said side walls may be put on said opposite side walls, and so that second lugs B, B′ may be formed which are composed of irregular quadrilaterals extending outward via folds 4, 5 in parallel with said bottom surface from the opposite side edges thereof, said irregular quadrilaterals being formed by putting triangle portions D, D′ on extensions C, C′ of said first lugs A, A′.

8 Claims, 3 Drawing Figures

PACKING INSIDE BAG FOR VISCOUS MATERIAL

BACKGROUND OF THE INVENTION (1) Field of the Invention

The present invention relates to a packing inner bag designed to fit within an outer box and to receive and hold, in leak free and sealed fashion, a viscous semisolid material therein.

(2) Description of the Prior Art

A viscous semisolid is usually heated in order to lower its viscosity to transform same into a fluid state. The material is then packed into suitable containers or packages, so that articles of the semisolid are manufactured.

Containers and packages employed in the prior art for this purpose include metallic containers, corrugated cardboard boxes baked with a release agent which is charged directly with the semisolid material, corrugated cardboard boxes or cardboard tubes into which semisolid material units previously wrapped in release agent-baked films or papers are packed, and release agent-baked deep drawn plastic dishes.

However, these conventional packages do not provide various requirements, such as providing perfect sealing properties, easiness of contents removal, excellent volumetric effiency and storage economy. For example, a viscous semisolid material generally tends to cause a so-called cold flow, and thus when a package containing such a material falls, the latter might flow out through a narrow small crevice, and in the case of the metallic containers, there are drawbacks such as the breakage of containers and the trouble in taking out a viscous material therefrom. Further, when a corrugated cardboard box is directly charged with the viscous material, it will be difficult to maintain perfect sealability and further, a cutter or the like is required for cutting the box to remove the contents therefrom. Consequently, cut chips might be mixed with the boxes contents. The plastic dishes have the problem that a release effect is insufficient. Furthermore, a suggestion that pieces of the semisolid material be wrapped one by one in wide sheets is expensive, since such a wide sheet must meet difficult and expensive process standards. Consequently, the foregoing containers and packages are all unsatisfactory for packing the semisolid materials thereinto.

SUMMARY OF THE INVENTION

It is an object of the present invention to provide a packing inner bag for a viscous semisolid material which prevents, the viscous semisolid material from leaking through its seams. The box is adequate to provide a sealing state perfect enough to prevent contamination with foreign matter, dispensing with the need for a cutter or the like for in opening the bag, the materials which are in the state of a semisolid when heated and which have a relatively low viscosity can easily be received therein, and a space volumetric efficiency is excellent. In short, according to the present invention, there can be provided packages in which drawbacks of the conventional known packages are overcome.

The above mentioned object of the present invention can be achieved by providing a packing inner bag for a viscous material having an opened upper end portion which is constructed by folding one blank laminated sheet having a thickness of 50 to 300 μm and comprising a polyethylene terephthalate (hereinafter referred to as PET) film an inner surface thereof which is treated with silicone and a glassine paper or a semiglassine paper. The bag is dimensioned to fit in an outside box.

DESCRIPTION OF THE PREFERRED EMBODIMENT

A glassine paper used in the present invention can be optionally selected from commercially available articles, having standard weights of 25 to 30 g/m$^2$, which are free of pinholes, and which have good properties. Additionally, commercial semiglassine papers having a lower transparency may also be employed. Both the glassine and semiglassine papers have high heat resistivities, so that they will scarcely deteriorate even when heated during packing of hot contents therein.

In the present invention, a release agent baking treatment of applying silicone onto sheets can be carried out in accordance with a known optional procedure such as a release agent baking treatment on the surface of the sheet by a thermal crosslinking after the application of a commercially available siloxane prepolymer. A thickness of the prepolymer membrane may not be always uniform, but it is important that only a uniform coating of the prepolymer is applied.

A laminated film consisting of the above mentioned PET film and glassine paper or semiglassine paper is one of preferable embodiments of the sheet for constituting the bag of the present invention, but other sheets can be used, so long as they are foldable and flexible enough the purposes of the present invention, and so long as their inner surfaces have the above-mentioned release properties. These sheets include a polyethylene fluoride resin such as Teflon (trade name) and ultra-high-molecular-weight polyethylene sheets, and in the cases of such sheets, the specific release agent baking treatment is unnecessary.

EXAMPLE

Next, the present invention is described in detail by reference to an example.

Figure 1:
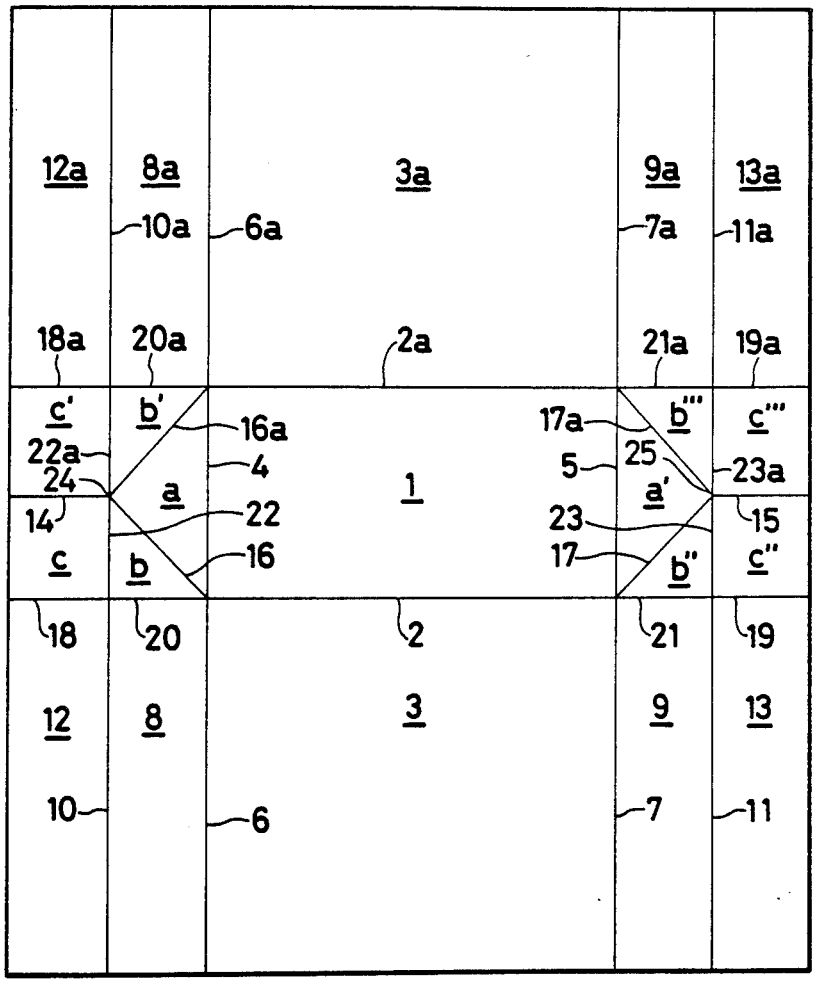
FIG. 1 is an expansion plan of a packing inner bag for a viscous material according to the present invention.
Figure 2:
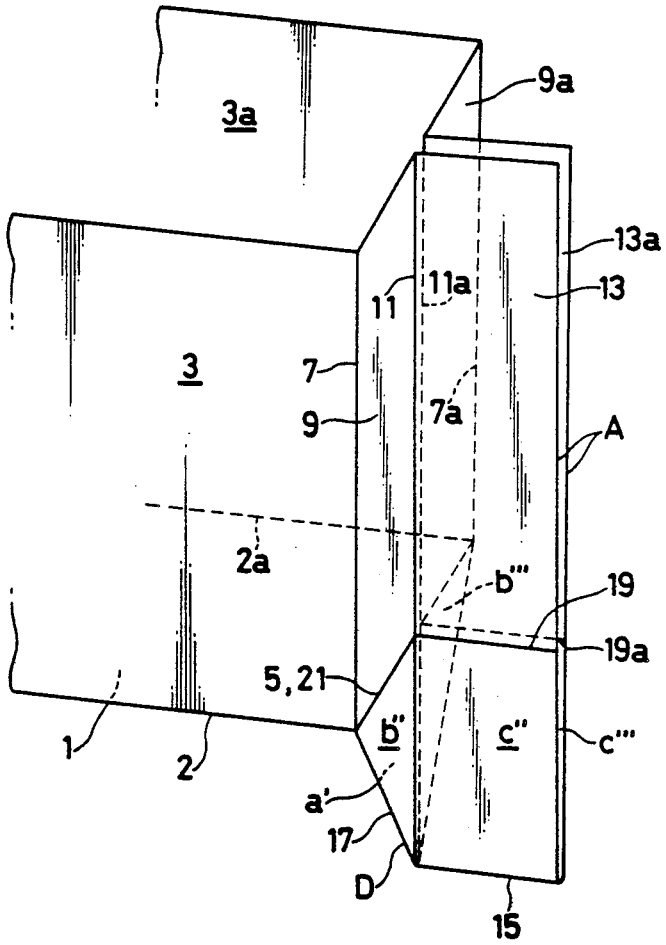
FIGS. 2 and 3 are partial perspective views illustrating intermediate assembly states of the bag.
Figure 3:
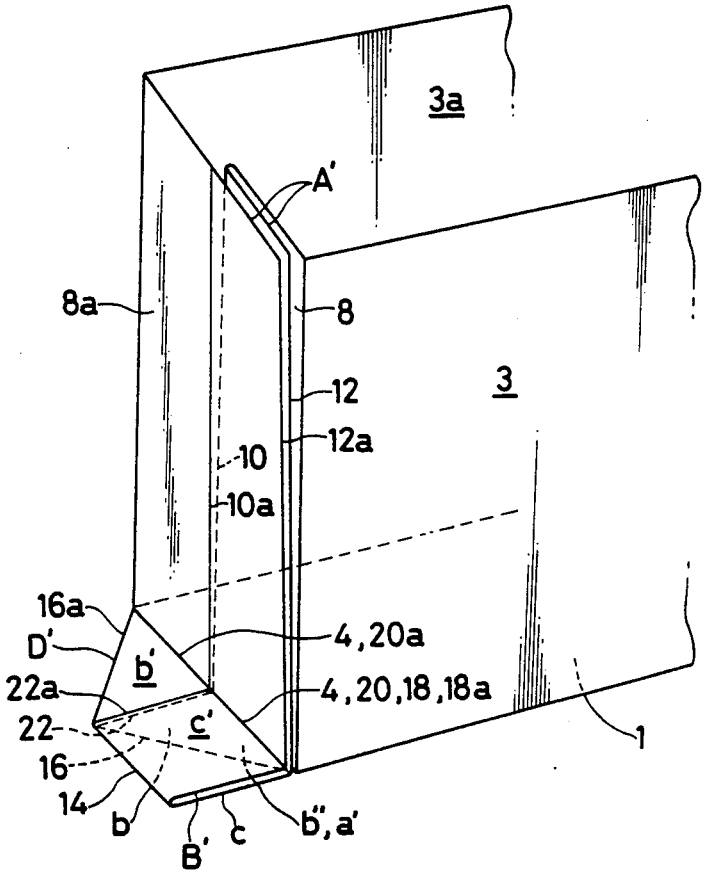

FIG. 1 shows an unfolded sheet from which a packing inner bag for a viscous material according to the present invention is formed. FIGS. 2 and 3 provide partial perspective views illustrating intermediate assembly states of the bag.

In FIG. 1, a bottom surface 1 having a rectangular shape is connected to a front wall 3 and a rear wall 3*a* along folds 2, 2*a*. The front wall 3 is provided, on the opposite side edges thereof, with said walls 8, 9 via folds 6, 7, and the rear wall 3*a* is likewise provided, on the opposite side edges thereof, with side walls 8*a*, 9*a* via folds 6*a*, 7*a*. Further, first lug flaps 12, 13 and 12*a*, 13*a* are provided along outer edges of the side walls 8, 9 and 8*a*, 9*a* via folds 10, 11 and 10*a*, 11*a*. Flaps C, C″ extending from flaps 12, 13 are provided along upper edges of flaps 12, 13 via folds 18, 19, and in like manner, flaps C′, C‴ extend from flaps 12*a*, 13*a* and are provided along lower edges of folds 12*a*, 13*a* via folds 18*a*, 19*a*.

A first lug A (see FIG. 2) is formed by associating the portion consisting of the first lug flap 13 and the flap C″ with the other portion consisting of the first lug flap 13*a* and the flap C''' along a fold 15, with their inner surfaces faced to each other, and another first lug A' (see FIG. 3) is likewise formed by associating the portion consisting of the first lug flap 12 and the flap C with the other portion consisting of the first lug flap 12*a* and the flap C' along a fold 14, with their inner surfaces faced to each other. Therefore, the four first lug flaps and the four flaps just described have the same size and the same rectangular shape.

Fold flaps a, a', b, b', b'' and b''' having a top angle of 90° and oblique sides of folds are provided along the opposite side edges of the bottom surface 1 via the folds 4, 5, and other folds 14, 15 are formed so as to extend horizontally from the top points 24, 25. A length of the folds 14, 15 is not limited in particular, but at least about 5 cm is necessary from the viewpoints of the prevention of the cold flow of contents through a crevice of the lugs A, A' and the easiness of a receipt of the inside bag having the lugs into an outside box. More preferably, the length of the folds 14, 15 is half of a length of the side wall plus the lug flap in a horizontal direction in FIG. 1.

Next, reference will be made to a procedure of constructing the thus constituted unfolding sheet so as to manufacture the packing inner bag of the present invention in accordance with the respective drawings.

In the first place, the front wall 3 and the rear wall 3*a* are uprightly raised along the folds 2, 2*a* on the upper and lower sides of the bottom surface 1 in FIG. 1 in order to construct the front wall and the rear wall. At this time, the first lug flaps 12, 12*a*, 13, 13*a* and the flaps C, C', C'', C''' are simultaneously raised, and by the use of these sections, the first lugs A and A' are constructed. Thus, the first lug A (FIG. 2) is formed by associating the portion consisting of the first lug flap 13 and the flap C'' with the other portion consisting of the first lug flap 13*a* and the flap C''' along a fold 15, with their inner surfaces facing one another, and the other first lug A' (FIG. 3) is, in like manner, formed by associating the portion consisting of the first lug flap 12 and the flap C with the other portion consisting of the first lug flap 12*a* and the flap C' along a fold 14, with their inner surfaces facing one another. The thus formed first lugs A, A' are fixed on the side edges thereof by a heat resistant adhesive tape or the like, if necessary.

By means of the above described procedure, the bag (FIGS. 2 and 3) can be prepared which has an opened upper end portion and a shape adapted to just fit inside an outer box (not shown).

Afterward, the fold flaps B'', b''' are folded inward along oblique folds 17, 17*a* via the folds 7, 11 and 7*a*, 11*a* so that the folds 21, 21*a* may be put on the base 5 of the flap a', in order to form side wall 9, 9*a* (FIG. 2) of the inside bag. In this case, the fold flaps b'', b''' are put on the inner surface of the flap a', so that a new triangle portion D (FIG. 2) is formed. In like manner, also at the other side wall, a new triange portion D' (FIG. 3) is formed.

The first lug A' is then folded along the folds 10, 10*a*, 22, 22*a* so as to join face to face with either of the side walls 8 and 8*a*. As a result, the flaps C, C' constituting the substantial extensions of the first lug A' are put on a part of the triangle portion D' in order to form a second lug B' (FIG. 3) having an irregular quadrilateral. In like manner, at the other side wall, another second lug B (not shown) is formed which extends outward in parallel with the bottom surface via the fold 5.

The thus prepared inner bag having the opened upper end portion is received in the outside box, but at this time, each of the second lugs B, B' is folded so as to join face to face with each side wall or the bottom surface connected thereto.

After having been received in the outside box, the inner bag is then charged with a suitably heated and therefore fluidized semisolid viscous material, and the upper portions alone of the side walls 8, 8*a* are then folded inward along the upper portions of the folds 10, 10*a* (FIG. 3) and the upper portions of the front wall and the rear wall are joined face to face with each other. Afterward, the joined portions are fixed by the use of an adhesive tape or like so as to airtightly seal the inner bag. The outside box preferably has an upper lid and is rectangular.

What is claimed is:

1. A packing inner bag suitable for retaining therein a semisolid viscous material and suitable for fitting within an outer box, said bag comprising:

an integral rectangular blank sheet having an inner surface coated with an agent having release properties, said sheet being folded to form said bag with a plurality of walls including:

a bottom wall sized to fit in said box, said bottom wall having a front edge, a rear edge opposite said front edge, a left edge, and an oppositely located right edge;

a front wall extending uprightly from said front edge, a rear wall extending uprightly from said rear edge; a left wall adjoining said left edge, said front wall and said rear wall; a right wall adjoining said right edge, said front wall and said rear wall; said bottom, front, rear, left and right walls defining an interior of said bag therebetween;

each one of said left and right walls respectively including a first wall portion folded from said front wall and extending towards said rear wall, a second wall portion folded from said rear wall and extending toward said front wall, said wall portions being long enough to meet at an uprightly extending center of said left or right walls, a first extending away portion continuing from said first wall portion and a second extending away portion continuing from said second wall portion, said first and second extending away portions extending away from said bag and overlapping one another without adhering to one another to form respectively a left lug at said left wall and a right lug at said right wall, the transverse dimension of said lugs measured in a direction parallel to the plane containing said bottom wall being long enough to seal said viscous material in said bag;

each one of said lugs being folded once along the upright longitudinal center to abut its respective left or right wall, without being folded onto itself.

2. An inside bag according to claim 1 wherein said sheet has heat resistance.

3. An inside bag according to claim 1 wherein said sheet is a laminated sheet comprising a paper and a polyester film an outer surface of which has been subjected to a release agent baking treatment.

4. An inside bag according to claim 3 wherein said paper is a glassine paper or a semiglassine paper.

5. The bag of claim 1, wherein the dimension of said left and right walls, measured from said front wall to said uprightly extending center is about equal to the dimension of said lug measured in a direction parallel to the plane of said bottom wall.

6. The bag of claim 1, wherein the excess of said integral blank sheet which is not in said walls of said bag extends at said left and right edges of said base and is in the shape of irregular quadrilaterals, said irregular quadrilaterals being folded, respectively, along said left and right edges of said bottom wall to, respectively, abut said left and right walls.

7. The bag of claim 1, wherein the excess of said integral blank sheet which is not in said walls of said bag extends at said left and right edges of said base and is in the shape of irregular quadrilaterals, said irregular quadrilaterals being folded, respectively, along said left and right edges of said bottom wall to abut said bottom wall.

8. The bag of claim 1, wherein said transverse dimension measures at least 5 centimeters.

* * * * *